US008480080B2

(12) United States Patent
Ujiie

(10) Patent No.: US 8,480,080 B2
(45) Date of Patent: Jul. 9, 2013

(54) SHEET PROCESSING DEVICE AND IMAGE FORMING APPARATUS

(75) Inventor: Masateru Ujiie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/527,725

(22) Filed: Jun. 20, 2012

(65) Prior Publication Data

US 2013/0001869 A1 Jan. 3, 2013

(30) Foreign Application Priority Data

Jun. 29, 2011 (JP) ..... 2011-144309

(51) Int. Cl.
*B65H 15/00* (2006.01)

(52) U.S. Cl.
USPC ..... 271/225; 271/184; 271/186; 399/364

(58) Field of Classification Search
CPC ... B65H 2301/3331; B65H 2301/33312; B65H 2301/33314
USPC ..... 271/225, 184, 186; 399/364
See application file for complete search history.

(56) References Cited

U.S. PATENT DOCUMENTS

| | | | | |
|---|---|---|---|---|
| 6,307,614 | B1 * | 10/2001 | Gaarder et al. | 355/24 |
| 7,974,567 | B2 * | 7/2011 | Park | 399/374 |
| 8,113,500 | B2 * | 2/2012 | Tsai et al. | 271/3.14 |
| 2009/0020942 | A1 * | 1/2009 | Lien et al. | 271/10.09 |
| 2009/0190976 | A1 * | 7/2009 | Tsai et al. | 399/361 |

FOREIGN PATENT DOCUMENTS

| | | |
|---|---|---|
| JP | 4-41361 | 2/1992 |
| JP | 2002-316758 | 10/2002 |
| JP | 2005-148365 | 6/2005 |

* cited by examiner

*Primary Examiner* — Kaitlin Joerger
(74) *Attorney, Agent, or Firm* — Cooper & Dunham LLP

(57) ABSTRACT

A sheet processing device includes a conveyance member, an elastic plate member, a first conveyance path, and a second conveyance path. The conveyance member conveys a sheet of recording media with the sheet attached thereon and has a circumferential portion to separate the sheet from the conveyance member by a curvature of the conveyance member. The first conveyance path is formed by the conveyance member. The second conveyance path is disposed downstream from the first conveyance path and includes a reversal conveyance path to reverse the sheet. A face continuous to a front edge of the elastic plate member, except for the front edge, is positioned in an attachment weakened area of the circumferential portion of the conveyance member in which an attachment force of the sheet on the circumferential portion is weakened by separation of the sheet from the conveyance member by the curvature.

6 Claims, 6 Drawing Sheets

SHEET PROCESSING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2011-144309, filed on Jun. 29, 2011 in the Japan Patent Office, the entire disclosure of which is hereby incorporated by reference herein.

BACKGROUND

1. Technical Field

This disclosure relates to a sheet processing device and an image forming apparatus, and more specifically to a sheet processing device including a sheet path switching mechanism and an image forming apparatus including the sheet processing device.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

Such inkjet recording forming apparatuses fall into two main types: serial-type image forming apparatuses that form images by ejecting droplets from the recording head while moving a carriage mounting the recording head in a main scanning direction, and line-head-type image forming apparatuses that form images by ejecting droplets from a linear-shaped recording head held stationary in the image forming apparatus.

For example, in a case where the image forming apparatus employing the liquid-ejection recording method is an equipment-type inkjet printer used for bookbinding or small-volume production of printed matters, the equipment-type inkjet printer may have multiple inkjet heads of thermal-type or piezoelectric-type for high-speed driving. Without moving the heads by, e.g., a carriage in a direction perpendicular to a sheet conveyance direction, the equipment-type inkjet printer can form images while the sheet is conveyed.

Inkjet recording apparatuses are widely used because of advantages of, e.g., high speed, less noise, less constraint in the available type of recording media, and ease of colorization.

As one image formation mode, image forming apparatuses may have a duplex printing mode to perform image formation on both front and back faces of a sheet of recording media. In the duplex printing mode, after a recording unit finishes image formation on a first face, i.e., a front face of the sheet, the sheet is reversed and conveyed to the recording unit again. Then, the recording unit forms an image on a second face, i.e., a back face of the sheet.

Conventionally, to switch the sheet conveyance direction between a route to output the sheet after image formation on the first face and a route to reverse the sheet, for example, JP-2005-148365-A and JP-2002-316758-A propose to provide a pivotable switching plate at a position at which the two routes converge.

JP-2005-148365-A proposes to provide a switching plate that can select an orientation to set the conveyance direction of the sheet fed from a sheet feed device to a direction toward an attachment belt opposing the recording unit or an orientation to set the conveyance direction of the sheet separated from the attachment belt after image recording to a direction toward a reversal conveyance unit. In JP-2005-148365-A, each orientation of the switching plate is set by a driving unit, such as a solenoid.

Recently, there has been an increased demand for reducing the processing time for image formation. To reduce the processing time, for example, enhancement of the sheet conveyance speed or reduction of the conveyance intervals between sheets have been employed. However, the above-described configuration in which the switching plate is driven by a solenoid does not meet the demand for reducing the processing time because a time lag occurs at the switching operation.

Hence, as a mechanism not requiring a driving source to switch the sheet conveyance direction, for example, JP-2002-316758-A proposes to provide elastic sheet members, such as mylar sheets, at the position of the switching plate to prevent the sheet having passed a first conveyance path from returning to the first conveyance path and guide the sheet to a second conveyance path. In the configuration described in JP-2002-316758-A, the elastic sheet members are arranged in the width direction of the sheet and have a single-support beam shape in which ends of the elastic sheet members are urged to overlap, i.e., contact ribs of a conveyance guide disposed at a side opposite a side at which base ends of the elastic sheet members are mounted.

Using the elastic sheet members of JP-2002-316758-A can cope with a delay of operation caused in the case in which the solenoid of JP-2005-148365-A is used. However, in the case where the elastic sheet members of JP-2002-316758-A are used instead of the switching plate of JP-2005-148365-A, the following problem may occur.

For example, in the case where the elastic sheet members of JP-2002-316758-A are used instead of the switching plate of JP-2005-148365-A, the front ends of the elastic sheet members contact the attachment belt.

In such a case, as described in JP-2005-148365-A, when the sheet is conveyed to the attachment belt, the front ends of the elastic sheet members are pushed by the front end of the sheet and separated from the attachment belt. As a result, the sheet is guided toward the attachment belt. When the sheet attached on the attachment belt moves to the reversal conveyance path, the sheet is separated from the attachment belt and guided to the reversal conveyance path by utilizing a contact of the front ends of the elastic sheet members with a surface of the attachment belt.

As described above, to guide the sheet to the reversal conveyance path, the front ends of the elastic sheet members need to contact the surface of the attachment belt. Consequently, the surface of the attachment belt is rubbed by front edge portions of the elastic sheet members, thus damaging and deteriorating the belt surface.

For the elastic sheet members of JP-2002-316758-A, both faces of each elastic sheet member are used as guide faces to guide the sheet. For example, a first face of each elastic sheet member is used to guide the sheet to the reversal conveyance path, and a second face of each elastic sheet member is used to feed the sheet from the reversal conveyance path. When the first face is used as the guide face, the front ends of the elastic sheet members contacting a guide portion are pushed and spread so as to separate from the guide portion. By contrast, when the second face is used as the guide face, the contact state of the front ends of the elastic sheet members with the guide portion is maintained so that the sheet can pass over the second faces of the elastic sheet members opposite the first faces contacting the guide portion.

Consequently, in the case where the elastic sheet members are used instead of the switching plate described in JP-2005-148365-A, with the front ends of the elastic sheet members contacting the guide portion, the second faces of the elastic sheet member cannot be used to direct the sheet toward the attachment belt again. Therefore, when the elastic sheet members of JP-2002-316758-A are applied to the configuration described in JP-2005-148356-A, it is necessary to provide a configuration to forcefully direct the sheet toward the attachment belt so that the sheet can be attached on the belt. As described above, using the elastic sheet members instead of the switching plate may cause a need for an additional configuration for sheet conveyance, thus resulting in cost increase due to increases in structural complexity and number of components.

BRIEF SUMMARY

In an aspect of this disclosure, there is provided a sheet processing device including a conveyance member, an elastic plate member, a first conveyance path, and a second conveyance path. The conveyance member conveys a sheet of recording media with the sheet attached thereon and has a circumferential portion to separate the sheet from the conveyance member by a curvature of the conveyance member. The elastic plate member has a fixed base end and an opposite end opposite the fixed base end. The opposite end contacts the circumferential portion of the conveyance member. The first conveyance path is formed by the conveyance member to convey the sheet. The second conveyance path is disposed downstream from the first conveyance path in a sheet conveyance direction of the first conveyance path and includes a reversal conveyance path to reverse the sheet sent from the conveyance member. The sheet conveyed along the first conveyance path is separated from the conveyance member by the curvature and introduced to the second conveyance path. The sheet reversed along the second conveyance path is conveyed to the circumferential portion of the conveyance member from a direction of a first angle different from a second angle at which the sheet is introduced from the first conveyance path to the second conveyance path, and attached on the conveyance member. A face continuous to a front edge of the elastic plate member, except for the front edge, is positioned in an attachment weakened area of the circumferential portion of the conveyance member in which an attachment force of the sheet on the circumferential portion of the conveyance member is weakened by separation of the sheet from the conveyance member by the curvature of the conveyance member.

In another aspect of this disclosure, there is provided an image forming apparatus including a sheet processing device. The sheet processing device includes a conveyance member, an elastic plate member, a first conveyance path, and a second conveyance path. The conveyance member conveys a sheet of recording media with the sheet attached thereon and has a circumferential portion to separate the sheet from the conveyance member by a curvature of the conveyance member. The elastic plate member has a fixed base end and an opposite end opposite the fixed base end. The opposite end contacts the circumferential portion of the conveyance member. The first conveyance path is formed by the conveyance member to convey the sheet. The second conveyance path is disposed downstream from the first conveyance path in a sheet conveyance direction of the first conveyance path and includes a reversal conveyance path to reverse the sheet sent from the conveyance member. The sheet conveyed along the first conveyance path is separated from the conveyance member by the curvature and introduced to the second conveyance path. The sheet reversed along the second conveyance path is conveyed to the circumferential portion of the conveyance member from a direction of a first angle different from a second angle at which the sheet is introduced from the first conveyance path to the second conveyance path, and attached on the conveyance member. A face continuous to a front edge of the elastic plate member, except for the front edge, is positioned in an attachment weakened area of the circumferential portion of the conveyance member in which an attachment force of the sheet on the circumferential portion of the conveyance member is weakened by separation of the sheet from the conveyance member by the curvature of the conveyance member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
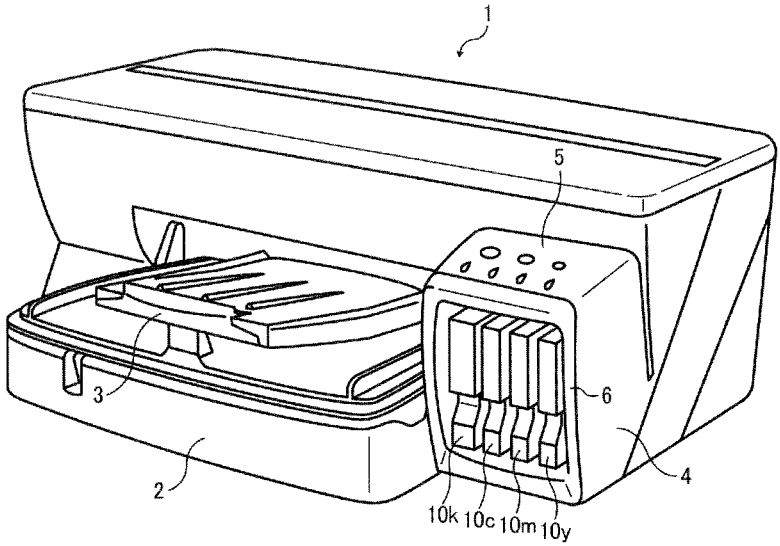
FIG. 1 is an external view of an image forming apparatus having a sheet processing device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" employing a liquid-ejection recording method refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium (in other words, the term "image formation" includes only causing liquid droplets to land on the medium).

The term "ink" as used herein is not limited to "ink" in a narrow sense and includes any types of liquid useable for image formation, such as recording liquid, fixing solution, resin, and chemical agent.

The term "sheet" used herein is not limited to a sheet of paper and includes anything, such as an OHP (overhead projector) sheet or a cloth sheet, on which ink droplets are attached. In other words, the term "sheet" is used as a generic term including a recording medium, a recorded medium, a recording sheet of paper, and a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below. In the following exemplary embodiments, an image forming apparatus is described taking an example of an inkjet recording apparatus. However, it is to be noted that a sheet processing device according to any of the exemplary embodiments can be used in any other suitable type of image forming apparatus.

FIG. 1 is an external perspective view of an inkjet recording apparatus serving as the image forming apparatus seen from the front side.

As illustrated in FIG. 1, the inkjet recording apparatus has a body 1, a sheet feed tray 2 mounted in the body 1 to store sheets, and a sheet output tray 3 removably mounted in the body 1 to stack the sheets after image recording (formation). At one end portion of a front face of the body 1 (a lateral side of the sheet feed tray 2 and the sheet output tray 3), the image forming apparatus has a cartridge mount part 4. An upper face of the cartridge mount part 4 is provided with an operation-and-indication unit 5 including, e.g., operation buttons and indicators.

Liquid cartridges 10*k*, 10*c*, 10*m*, and 10*y* (hereinafter referred to as "liquid cartridges 10" unless colors distinguished) to separately store different color liquids (inks) of, e.g., black (K), cyan (C), magenta (M), and yellow (Y) are mounted in the cartridge mount part 4. The liquid cartridges 10 are inserted from the front side of body 1 toward the rear side of the body 1 to be installed to the cartridge mount part 4. At a front face side of the cartridge mount part 4, a front cover 6 is openably/closably disposed so as to open when the liquid cartridges 10 are installed to or removed from the cartridge mount part 4.

Next, a mechanical section of the inkjet recording apparatus is described with reference to FIG. 2.

Figure 2:
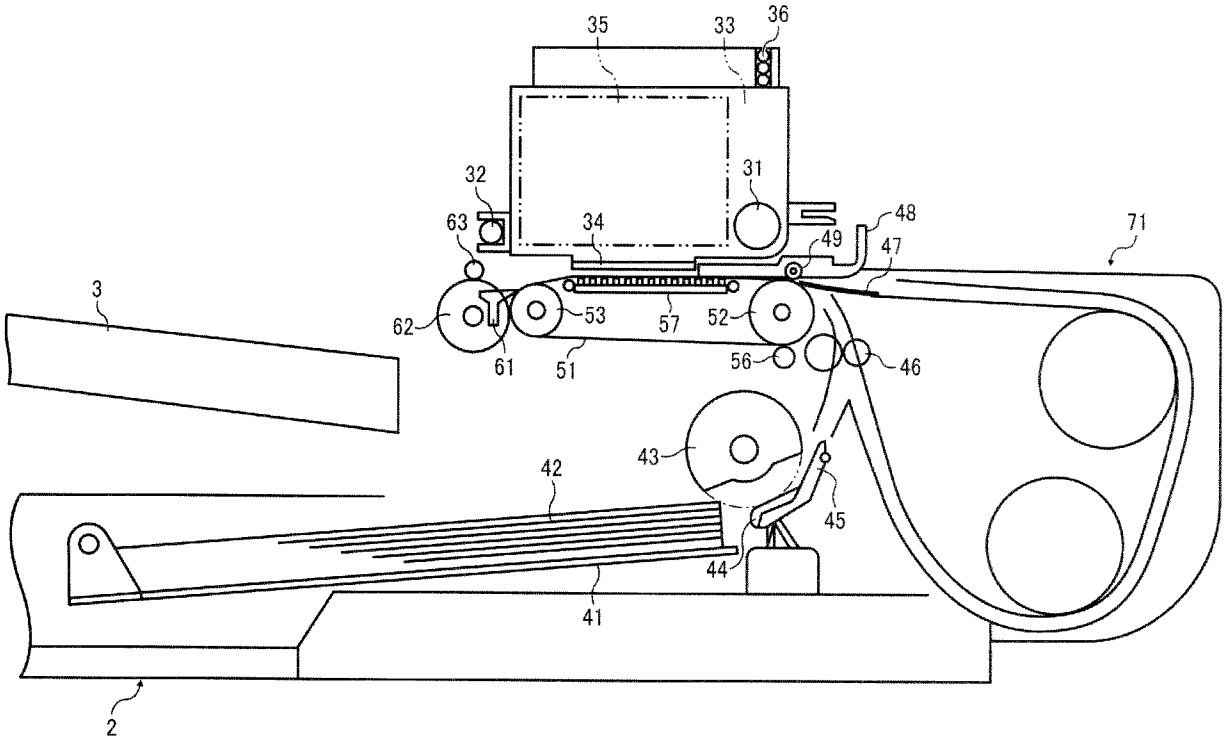
FIG. 2 is a schematic view of an internal configuration of the image forming apparatus of FIG. 1.

FIG. 2 is a schematic side view of the mechanical section of the inkjet recording apparatus.

In FIG. 2, the front side of the inkjet recording apparatus is disposed at the left side of FIG. 2. A carriage 33 is supported by a main guide rod 31 and a sub guide rod 32 extending between main side plates 21A and 21B so that the carriage 33 is slidable in a main scanning direction. The carriage 33 is reciprocally moved for scanning in the main scanning direction (a direction perpendicular to a printed sheet face of FIG. 2) by a main scanning motor via a timing belt.

The carriage 33 mounts liquid ejection heads 34 having multiple nozzle rows to eject droplets of the different color liquids of black (K), cyan (C), magenta (M), and yellow (Y).

The carriage 33 also mounts a plurality of liquid tanks 35 to supply the different color liquids to the respective liquid ejection heads 34. The different color liquids are replenished from the respective liquid cartridges 10 mounted in the cartridge mount part 4 to the liquid tanks 35 via flexible supply tubes 36 dedicated for the respective colors.

The inkjet recording apparatus further includes a sheet feed section to feed sheets 42 stacked on a sheet stack portion 41 of the sheet feed tray 2. The sheet feed section further includes a sheet feed roller 43 and a separation pad 44. The sheet feed roller 43 separates and feeds the sheets 42 sheet by sheet from the sheet stack portion 41. The separation pad 44 is made of a material of a high friction coefficient and disposed facing the sheet feed roller 43.

To feed the sheet 42 from the sheet feed section to an area below the liquid ejection heads 34, the inkjet recording apparatus has a first guide member 45 to guide the sheet 42, a counter roller 46, a conveyance guide member 47, a pressure member 48 having a front-end press roller 49, and a conveyance belt 51. The conveyance belt 51 serves as a conveyance member to convey the sheet 42 to a position opposing the liquid ejection heads 34 with the sheet 42 electrostatically attached thereon.

The conveyance belt 51 is an endless belt looped between a conveyance roller 52 and a tension roller 53 to circulate forward and in reverse in a belt conveyance direction (sub-scanning direction). A charging roller 56 serving as a charging device is provided to charge an outer surface of the conveyance belt 51. The charging roller 56 is disposed so as to contact the outer surface of the conveyance belt 51 and rotate with the circulation of the conveyance belt 51. On the back (inner) side of the conveyance belt 51, a second guide member 57 serving as a platen unit is disposed at a position corresponding to a print (recording) area of the liquid ejection heads 34. It is to be noted that the configuration of the conveyance belt 51 is not limited to the above-described electrostatic attachment structure using the charging roller 56 but may be any other suitable attachment structure, e.g., an attachment structure using a force of negative pressure.

The inkjet recording apparatus further includes a sheet output section to output the sheet 42 having an image formed by the liquid ejection heads 34. The sheet output section includes a separation claw 61 to separate the sheet 42 from the conveyance belt 51, a first output roller 62, and a second output roller 63. The sheet output tray 3 is disposed below the first output roller 62.

A duplex unit 71 is mounted on a back face portion of the body 1. When the conveyance belt 51 rotates in reverse to return the sheet 42, the duplex unit 71 receives the sheet 42, turns the sheet 42 upside down, and feeds the sheet 42 to the counter roller 46 again.

In the liquid-ejection head recording apparatus having the above-described configuration, the sheet 42 is separated sheet by sheet from the sheet feed tray 2, fed in a substantially vertically upward direction, guided along the first guide member 45, and conveyed by the counter roller 46. Further, the front end of the sheet 42 is guided by the conveyance guide member 47 and pressed against the conveyance belt 51 by the front-end press roller 49 to turn the conveyance direction of the sheet 42.

At this time, an alternating current (AC) bias supply unit of a controller applies alternating voltages to the charging roller 56 so that plus outputs and minus outputs are alternately repeated. As a result, the conveyance belt 51 is charged in an alternately-charged voltage pattern, that is, an alternating band pattern of positively-charged areas and negatively-charged areas having a certain width in the sub-scanning direction, i.e., the belt circulation direction. When the sheet 42 is fed onto the conveyance belt 51 alternately charged with positive and negative voltages, the sheet 42 is attached on the conveyance belt 51 by electrostatic force and conveyed in the sub scanning direction by the circulation of the conveyance belt 51. By driving the liquid ejection heads 34 according to image signals while moving the carriage 33, liquid droplets are ejected onto the sheet 42 stopped below the liquid ejection heads 34 to form one line of a desired image. After the sheet 42 is fed by a certain amount, another line of the image is recorded on the sheet 42. Receiving a signal indicating that the image recording has been completed or the rear end of the sheet 42 has arrived at the recording area, the liquid ejection heads 34 finish the recording operation and the sheet 42 is output to the sheet output tray 3.

Apart from the above-described case where printing is performed on the sheet 42 fed from the sheet feed tray 2, for example, when the sheet 42 having an image printed on one face is returned to the duplex unit 71, or when the sheet 42 is fed from a side opposite to the duplex unit 71 in an extending direction, i.e., a side at which the sheet output tray 3 is disposed in FIG. 2, the conveyance belt 51 circulates in reverse, i.e., in a direction opposite to the forward direction in which the conveyance 51 circulates when the sheet 42 is fed from the sheet feed tray 2.

Figure 3:
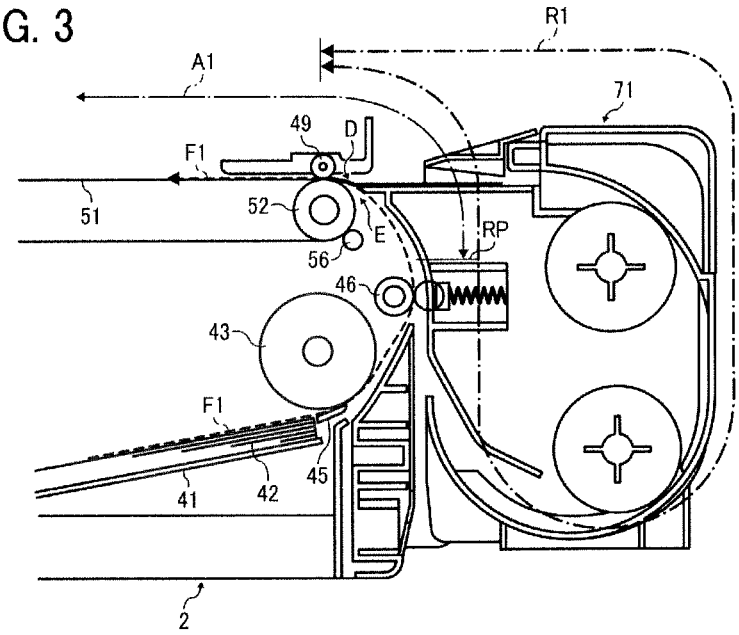
FIG. 3 is a schematic view of a configuration of a sheet conveyance section and a sheet conveyance mode in the internal configuration of the image forming apparatus of FIG. 2.
Figure 4:
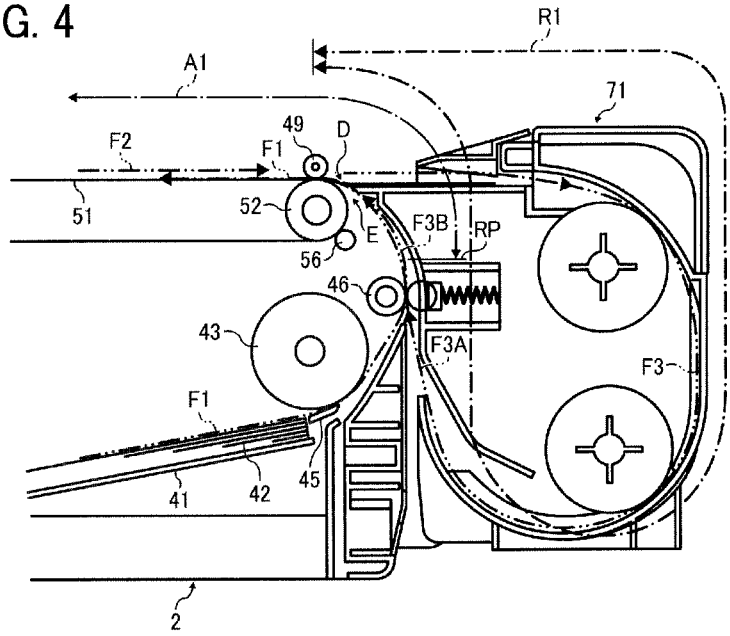
FIG. 4 is a schematic view of the configuration of the sheet conveyance section of FIG. 3 and another sheet conveyance mode in the internal configuration of the image forming apparatus of FIG. 2.

FIGS. 3 and 4 are schematic views of the sheet conveyance section used in the mechanical section of FIG. 2.

The sheet conveyance section illustrated in FIGS. 3 and 4 has a first conveyance path A1 and a second conveyance path R1. Through the first conveyance path A1, the sheet conveyance section can move the sheet 42 forward or in reverse when image recording is performed on a single face or double faces of the sheet 42. The second conveyance path R1 includes a reverse conveyance path to reverse the sheet when image recording is performed on double faces of the sheet 42.

The first conveyance path A1 includes a range from the position of the counter roller 46 as a reference position RP (in FIGS. 3 and 4, the reference position is located at a position slightly upper than the counter roller 46 for the sale of clarity) to a recording section via a position of the conveyance roller 52 having a circumferential portion in which the conveyance belt 51 is wound. Through the first conveyance path A1, the sheet is conveyed to a sheet entry portion E at which the sheet is attached on the conveyance belt 51. The first conveyance path A1 also includes a route to move the sheet from the recording section to the sheet output tray 3.

The second conveyance path R1 includes a sheet introduction portion D to move the sheet 42 to the conveyance belt 51 at an angle differing from an entry angle (in FIGS. 3 and 4, a substantially vertical angle) of the sheet 42 at the sheet entry portion E relative to the conveyance belt 51, i.e., at an angle substantially perpendicular to the substantially vertical angle in FIGS. 3 and 4. The second conveyance path R1 includes a route to reverse the sheet 42 having sent from the conveyance belt 51 and move the sheet 42 to the sheet entry portion E of the first conveyance path A1 again.

Since the conveyance belt 51 is wound around a circumferential surface of the conveyance roller 52, the surface of the conveyance belt has a circumferential shape along the circumferential surface of the conveyance roller 52. Thus, the sheet 42 attached on the conveyance belt 51 by static electricity can be separated from the conveyance belt 51 by the curvature of the conveyance belt 51.

FIG. 3 shows a conveyance mode in a case where recording operation is performed on only a single face of the sheet 42.

In this case, only the first conveyance path A1 is used. In other words, in the first conveyance path A1, as indicated by an arrow F1 in FIG. 3, the sheet 42 picked up from the sheet stack portion 41 is conveyed by the counter roller 46 to a sandwiching conveyance portion at which the conveyance roller 52 opposes the front-end press roller 49, via the sheet entry portion E at which the sheet 42 starts to be attached on the conveyance belt 51.

With the circulation of the conveyance belt 51, the sheet 42 having arrived at the sandwiching conveyance portion is conveyed to the position below the liquid ejection heads 34 of the recording section. For the single-face recording of the sheet 42, after the recording is finished, the sheet 42 continues to be conveyed by the conveyance belt 51 and separated from the conveyance belt 51 by the separation member 61. Then, the first output roller 62 and the second output roller 63 discharge the sheet 42 to the sheet output tray 3.

FIG. 4 shows a conveyance mode in a case where image recording is performed on both faces of the sheet 42.

In this case, both the first conveyance path A1 and the second conveyance path R1 are used. When recording operation is performed on a first face of the sheet 42, the above-described conveyance mode illustrated in FIG. 3 is used except for the conveyance of the sheet to the sheet output tray 3. After the recording of the first face is finished, the conveyance roller 52 and the front-end press roller 49 rotate in a reverse direction opposite a direction in which the conveyance roller 52 and the front-end press roller 49 rotate when the first face is recorded. As a result, as indicated by an arrow F2 in FIG. 4, the sheet 42 is introduced from the recording section via the sheet entry portion E to the sheet introduction portion D of the second conveyance path R1 and moved in a direction indicated by arrows F3, F3A, and F3B to be reversed. When the sheet 42 arrives at the counter roller 46, the counter roller 46 feeds the sheet 42 toward the recording section again.

The above-described configuration is further described below. In this exemplary embodiment, the conveyance guide member 47 is disposed at the position at which the sheet 42 having conveyed from the sheet entry portion E of the first conveyance path A1 is introduced to the second conveyance path R1.

The conveyance guide member 47 is an elastic plate member, e.g., a mylar plate and disposed at a position at which the sheet entry portion E of the first conveyance path A1 and the sheet introduction portion D of the second conveyance path R1 converge. The conveyance guide member 47 is a cantilever member having a base end fixed at the duplex unit 71 including the second conveyance path R1.

Figure 5:
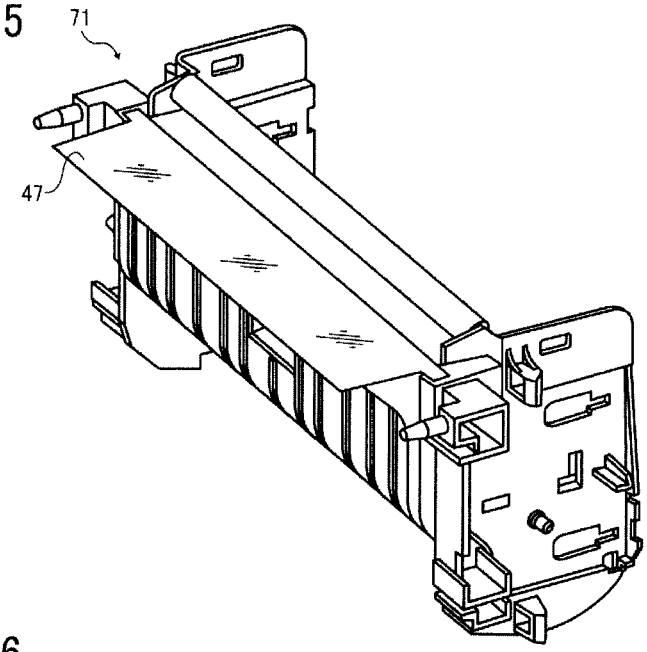
FIG. 5 is an external view of an elastic plate member in an installed state.
Figure 6:
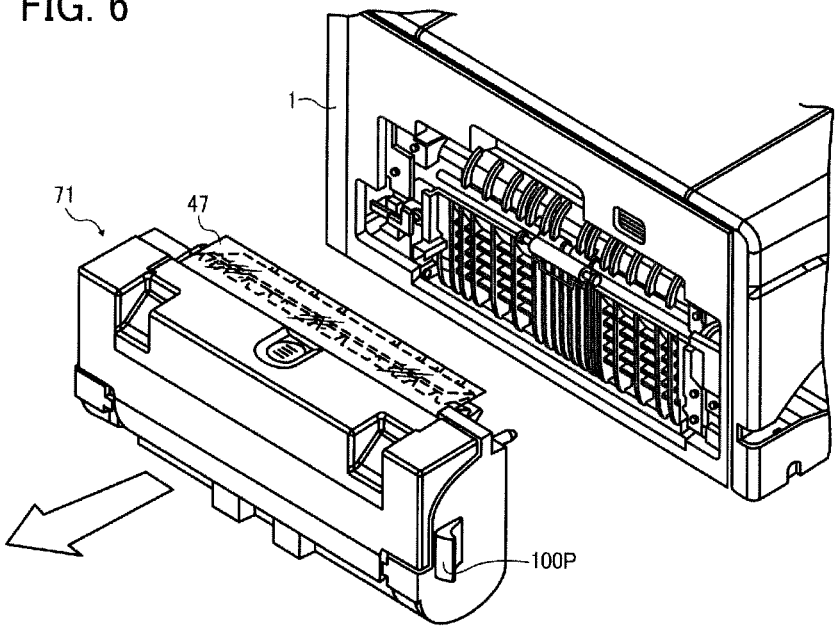
FIG. 6 is an external view of a duplex unit mounting the elastic plate member and including a second conveyance path in a state in which the duplex unit is removed from the image forming apparatus.

FIGS. 5 and 6 show states at which the base end of the conveyance guide member 47 is fixed at the duplex unit 71.

In FIG. 5, a cover of the duplex unit 71 and internal devices are removed. In FIG. 6, the cover is mounted on the duplex unit 71.

Figure 7A:
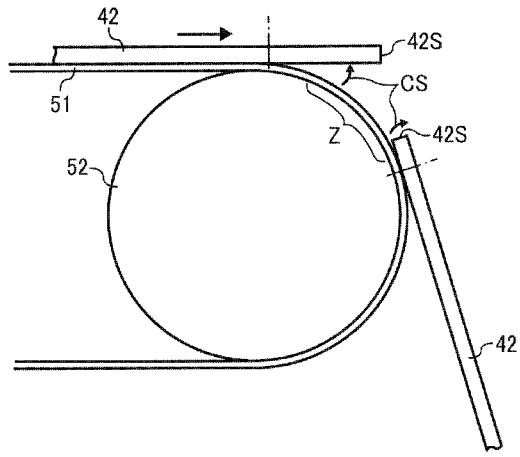
FIGS. 7A to 7C are schematic views of configuration principles of the sheet processing device.
Figure 7B:
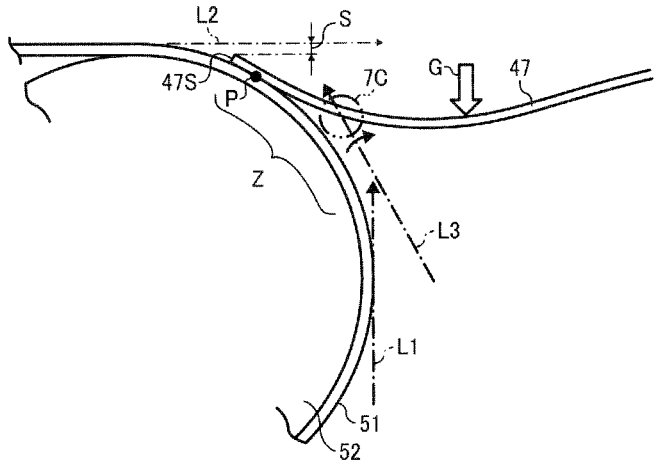
Figure 7C:
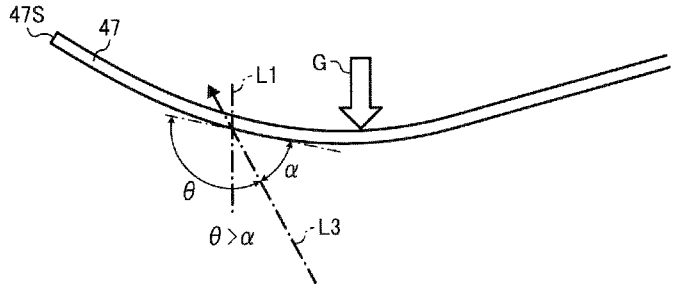

FIGS. 7A to 7C are schematic views showing operation principle and configuration of the conveyance guide member 47.

As described above, the conveyance guide member 47 has the base end fixed at the duplex unit 71. As illustrated in FIG. 7B, a face P continuous to the front edge 47S, except for the front edge 47S, is positioned in an area Z in which the attachment force of the sheet 42 on the circumferential portion of the conveyance belt 51 is weakened by the curvature separation of the conveyance belt 51.

In FIG. 7A, the area Z in which the attachment force of the sheet 42 is weakened by the curvature separation corresponds to the following area.

In the circumferential portion of the conveyance belt 51 wound around the conveyance roller 52, the area Z ranges from a position at which a front end 42S of the sheet 42 is more likely to separate from the circumferential surface of the conveyance belt 51 by the flexural rigidity of the sheet in a substantially horizontal direction, i.e., a sheet conveyance direction from the first conveyance path A1 to the second conveyance path R1 (indicated by an arrow L2 in FIG. 7B) and a position at which the front end 42S of the sheet 42 is more likely to separate from the circumferential surface in an entry direction of the sheet 42 (indicated by an arrow L3 in FIG. 7B), which is a direction other than the substantially horizontal direction, i.e., a direction inclined at an angle toward the vertical direction from the substantially horizontal direction. The area Z also corresponds to an area in which the front end 42S of the sheet 42 attached on the conveyance belt 51 by static electricity arrives at the circumferential portion of the conveyance belt 51 and separates from the conveyance belt 51 by curvature separation utilizing its flexural rigidity. The curvature separation is illustrated in FIG. 7A as a state in which the front end 42S of the sheet 42 is separated from the conveyance belt 51 as indicated by arrows CS.

In the area Z in which the attachment force decreases, the face P continuous to the front edge 47S of the conveyance guide member 47, except for the front edge 47S, is positioned, thus allowing the sheet 42 to be separated by utilizing a weakened attachment force of the sheet 42. Such a configuration can prevent a delay of operation caused in a case where, e.g., a switching plate driven by a solenoid is used to separate the sheet, and can effectively use the curvature separation of the sheet itself, thus obviating a special separation mechanism.

The face P continuous to the front edge 47S of the conveyance guide member 47, except for the front edge 47S, contacts the circumferential portion of the conveyance belt 51 at the state illustrated in FIG. 7B. In this exemplary embodiment, the conveyance guide member 47 is pressed in a direction indicated by an arrow G in FIG. 7B. As a result, the face P continuous to the front edge 47S is bent to contact the above-described area Z except for the front edge 47S. In FIG. 7B, the area Z is disposed at a position lower than a tangent line (indicated by the arrow L2) to the circumferential portion of the conveyance belt 51 at a point at which the sheet moves from the first conveyance path A1 to the second conveyance path R1. By pressing the conveyance guide member 47, the front edge 47S of the conveyance guide member 47 is placed at a position adjacent to and lower than the tangent line L2 in the area Z (i.e., is lowered from the tangent line L2 by a distance S in FIG. 7B). As a result, the front edge 47S of the conveyance guide member 47 floats up from the circumferential portion of the conveyance belt 51. Thus, as illustrated in FIG. 7B, the face P continuous to the front edge 47S, except for the front edge 47S, can contact the circumferential portion of the conveyance belt 51.

Such a configuration can prevent the front edge 47S from rubbing the circumferential portion of the conveyance belt 51, thus preventing damage to the surface of the conveyance belt 51 and a reduction in the strength of the belt. In addition, since only the face P continuous to the front edge 47S, except for the front edge 47S, contacts the circumferential portion of the conveyance belt 51, the sheet 42 conveyed toward the sheet entry portion of the first conveyance path is forcefully pressed toward the surface of the conveyance belt 51 by the face P continuous to the front edge 47S. Such a configuration can attach the sheet 42 on the conveyance belt 51 without providing a special induction mechanism with the conveyance belt 51.

In addition, since the front edge 47S of the conveyance guide member 47 is placed lower than the tangent line L2 parallel to the direction in which the sheet 42 is conveyed toward the sheet introduction portion of the second conveyance path R1, the front edge 47S does not interfere with the sheet 42 moving toward the sheet introduction portion of the second conveyance path R1. Such a configuration allows sheet conveyance without interference with the movement of the sheet 42.

By pressing the conveyance guide member 47, as illustrated in FIG. 7C, when the reversed sheet 42 moves toward the circumferential portion of the conveyance belt 51, the inclination of the front end of the sheet 42 (in a direction indicated by an arrow L3 in FIG. 7C) is set so that an entry-side face of the sheet has an obtuse angle θ relative to a tangent line to a surface of the conveyance guide member 47. By contrast, a face opposite to the entry-side face has an acute angle a relative to the tangent line L3. Since the entry-side face of the conveyance guide member 47 has the obtuse angle, the sheet 42 can move toward the sheet entry portion at a less bent state, thus allowing the sheet 42 to move to the sheet entry portion E without increasing sliding resistance.

Next, operation of the conveyance guide member 47 in this exemplary embodiment is described below with reference to FIGS. 8A and 8B.

Figure 8A:
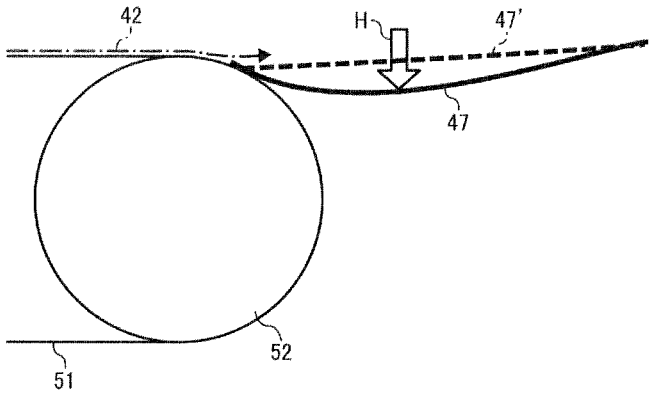
FIG. 8 is a schematic view of operation of the sheet processing device of FIG. 7.

FIG. 8A shows a state in which the sheet 42 is introduced from the first conveyance path A1 to the sheet introduction portion of the second conveyance path R1. FIG. 8B is a state in which the sheet 42 is conveyed from the second conveyance path R1 to the sheet entry portion of the first conveyance path A1.

In FIG. 8A, when, as indicated by an arrow H, the conveyance guide member 47 is pressed from an initial state indicated by a broken line 47', the face P continuous to the front edge 47S, except for the front edge 47S, is pressed downward. As a result, the face P continuous to the front edge 47S, except for the front edge 47S, is positioned in the area Z (illustrated in FIG. 7) of the circumferential portion of the conveyance belt 51, so that only the face P continuous to the front edge 47S, except for the front edge 47S, contacts the circumferential portion. From this state, when the conveyance belt 51 starts to circulate in the reverse direction (clockwise direction in FIG. 8A) opposite to the forward direction in which the conveyance belt 51 circulates during recording operation, the sheet 42 moves from the first conveyance path A1 toward the second conveyance path R1 and arrives at the sheet introduction portion of the second conveyance path R1, i.e., the circumferential portion of the conveyance belt 51.

When the sheet 42 moves from the first conveyance path A1 toward the second conveyance path R1, as illustrated in FIG. 7B, the front edge 47S of the conveyance guide member 47 is placed lower than the tangent line L2 parallel to the conveyance direction of the sheet 42. As a result, the front edge 47S of the conveyance guide member 47 does not interfere with movement of the sheet 42 separated from the circumferential portion of the conveyance belt 51 by curvature separation.

Figure 8B:
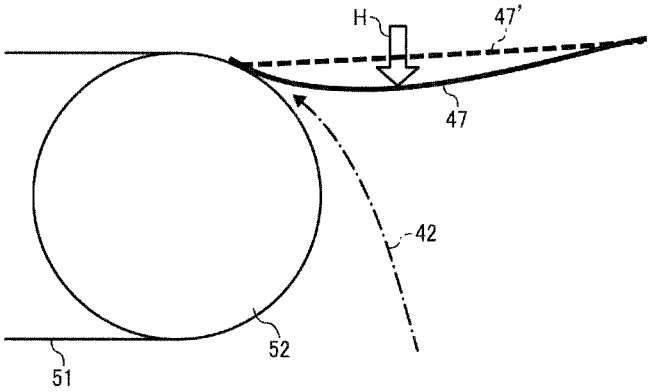

In addition, as illustrated in FIG. 8B, when the front end of the sheet 42 moving along the second conveyance path R1 faces the conveyance guide member 47, the front end of the sheet 42 is separated from the conveyance belt 51 by curvature separation in the area Z in which the attachment force of the sheet 42 decreases at the circumferential portion of the conveyance belt 51. Then, the front end of the sheet 42 is forcefully pressed against the circumferential portion of the conveyance belt 51 by the face P not including the front edge 47S but continuous to the front edge 47S.

In the above-described exemplary embodiment, by simply setting only the positional and contact relations of the face not including but being continuous to the front edge of the conveyance guide member serving as an elastic plate member and the circumferential portion of the conveyance belt, the position and orientation of separation and attachment of the sheet can be determined Such a configuration allows separation and refeeding of the sheet according to recording modes while adjusting the existing configuration. In addition, unlike a case where the front edge of the conveyance guide member contacts the conveyance belt, the conveyance guide member face-to-face contacts the conveyance belt, thus reducing sliding resistance and preventing damage to the surface of the conveyance belt.

In this exemplary embodiment, the image forming apparatus is described taking an example of the inkjet recording apparatus. However, the image forming apparatus is not limited to the inkjet recording apparatus but may be, for example, an electrophotographic-type image forming apparatus.

In addition, in this exemplary embodiment, the conveyance member is described taking an example of the conveyance belt. However, the conveyance member is not limited to the conveyance belt but may be, for example, a conveyance roller.

Furthermore, in this exemplary embodiment, the first conveyance path and the second conveyance path converge at one end of the conveyance member. However, for example, the first conveyance path and the second conveyance path may be separately disposed at the upstream side and the downstream side from the conveyance member.

According to this exemplary embodiment, the elastic plate member is disposed at a position at which the first conveyance path is connected to the second conveyance path. The face continuous to the front edge of the elastic plate member, except for the front edge, is positioned in the area in which the attachment force of the sheet on the circumferential portion of the conveyance member is weakened by the curvature separation at the circumferential portion. As a result, only the face continuous to the front edge of the elastic plate member, except for the front edge, contacts the circumferential portion of the conveyance member, and the front edge of the elastic plate member does not contact the circumferential portion of the conveyance member. Such a configuration can prevent damage to the surface of the conveyance member that may be otherwise caused by a contact of the front edge of the elastic plate member against the circumferential portion of the conveyance member.

In addition, the face continuous to the front edge of the elastic plate member, except for the front edge, is positioned in the area in which the attachment force of the sheet on the conveyance member decreases due to the curvature separation of the sheet from the conveyance member, thus facilitating separation of the sheet. As a result, the sheet can be reliably introduced from the first conveyance path to the second conveyance path without a special separation mechanism.

In addition, by pressing the elastic plate member, the inclination of the front end of the reversed sheet moving toward the area in which the attachment force of the sheet decreases is set to an obtuse angle relative to a tangent line to a surface of the elastic plate member, thus reducing the resistance against the movement of the sheet. Further, while the face continuous to the front edge of the conveyance guide member, except for the front edge, contacts the conveyance member, the reversed sheet moves to the circumferential portion of the conveyance member. Such a configuration allows the sheet to be attached on the conveyance member without a special guide structure.

Furthermore, by pressing the elastic plate member, the front edge of the elastic plate member faces the circumferential portion of the conveyance member in the above-described area in a non-contact state. The front edge of the elastic plate member is also positioned at a position lower than and adjacent to the tangent line parallel to the direction in which the sheet moves from the first conveyance path to the second conveyance path. Such a configuration prevents the front edge of the elastic plate member from interfering with movement of the sheet from the first conveyance path to the second conveyance path.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet processing device comprising:

a conveyance member to convey a sheet of recording media with the sheet attached thereon, the conveyance member having a circumferential portion to separate the sheet from the conveyance member by a curvature of the conveyance member;

an elastic plate member having a fixed base end and an opposite end opposite the fixed base end, the opposite end contacting the circumferential portion of the conveyance member;

a first conveyance path formed by the conveyance member to convey the sheet; and a second conveyance path disposed downstream from the first conveyance path in a sheet conveyance direction of the first conveyance path and including a reversal conveyance path to reverse the sheet sent from the conveyance member, wherein the sheet conveyed along the first conveyance path is separated from the conveyance member by the curvature and introduced to the second conveyance path, the sheet reversed along the second conveyance path is conveyed to the circumferential portion of the conveyance member from a direction of a first angle different from a second angle at which the sheet is introduced from the first conveyance path to the second conveyance path, and attached on the conveyance member, and a face continuous to a front edge of the elastic plate member, except for the front edge, is positioned in an attachment weakened area of the circumferential portion of the conveyance member in which an attachment force of the sheet on the circumferential portion of the conveyance member is weakened by separation of the sheet from the conveyance member by the curvature of the conveyance member.

2. The sheet processing device of claim 1, wherein the attachment weakened area of the circumferential portion is located within a range from a position at which the sheet is introduced from the first conveyance path to the second conveyance path to a position at which the sheet reversed along the second conveyance path is conveyed to the circumferential portion.

3. The sheet processing device of claim 1, wherein the elastic plate member is pressed so that the face, except for the front edge, contacts the attachment weakened area, and an inclination of a front end of the sheet reversed along the second conveyance path and moving toward the attachment weakened area is set to an obtuse angle relative to a tangent line to a surface of the elastic plate member at a side of the sheet facing the circumferential portion.

4. The sheet processing device of claim 1, wherein the elastic plate member is pressed so that the front edge of the elastic plate member faces the circumferential portion of the conveyance member without contacting the circumferential portion, and the front edge is positioned at a position lower than and adjacent to a tangent line of the sheet moving along the first conveyance path relative to the circumferential portion.

5. The sheet processing device of claim 1, wherein the conveyance member is a belt wound around a roller to attach the sheet on the belt, and the face continuous to the front edge of the elastic plate member, except for the front edge, contacts a circumferential portion of the roller.

6. An image forming apparatus comprising a sheet processing device, the sheet processing device comprising, a conveyance member to convey a sheet of recording media with the sheet attached thereon, the conveyance member having a circumferential portion to separate the sheet from the conveyance member by a curvature of the conveyance member;

an elastic plate member having a fixed base end and an opposite end opposite the fixed base end, the opposite end contacting the circumferential portion of the conveyance member;

a first conveyance path formed by the conveyance member to convey the sheet; and a second conveyance path disposed downstream from the first conveyance path in a sheet conveyance direction of the first conveyance path and including a reversal conveyance path to reverse the sheet sent from the conveyance member, wherein the sheet conveyed along the first conveyance path is separated from the conveyance member by the curvature and introduced to the second conveyance path, the sheet reversed along the second conveyance path is conveyed to the circumferential portion of the conveyance member from a direction of a first angle different from a second angle at which the sheet is introduced from the first conveyance path to the second conveyance path, and attached on the conveyance member, and a face continuous to a front edge of the elastic plate member, except for the front edge, is positioned in an attachment weakened area of the circumferential portion of the conveyance member in which an attachment force of the sheet on the circumferential portion of the conveyance member is weakened by separation of the sheet from the conveyance member by the curvature of the conveyance member.

* * * * *